United States Patent [19]

Kuhn

[11] Patent Number: 4,512,528

[45] Date of Patent: Apr. 23, 1985

[54] DEVICE FOR EXCHANGING A WINDING MANDREL

[76] Inventor: Klaus G. Kuhn, Wingertweg 52, 8750 Aschaffenburg 19, Fed. Rep. of Germany

[21] Appl. No.: 490,490

[22] Filed: May 2, 1983

[51] Int. Cl.[3] ..... B65H 17/12; B65H 19/06

[52] U.S. Cl. ..... 242/56 R; 242/66; 242/79

[58] Field of Search ..... 242/56 R, 66, 67.1 R, 242/79, 80, 68

[56] References Cited

U.S. PATENT DOCUMENTS

| | | | |
|---|---|---|---|
| 2,561,543 | 7/1951 | Teplitz | 242/79 |
| 2,880,943 | 4/1959 | Stephens | 242/67.1 R |
| 3,061,221 | 10/1962 | Aulen | 242/66 |
| 3,176,928 | 4/1965 | Saunders | 242/68 X |
| 3,669,372 | 6/1972 | De Jong | 242/67.1 R |
| 3,727,854 | 4/1973 | Grotzbach | 242/66 |

FOREIGN PATENT DOCUMENTS

| | | | |
|---|---|---|---|
| 628864 | 10/1961 | Canada | 242/66 |

*Primary Examiner*—Stuart S. Levy
*Assistant Examiner*—Lloyd D. Doigan
*Attorney, Agent, or Firm*—Leydig, Voit, Osann, Mayer and Holt, Ltd.

[57] ABSTRACT

The invention relates to a device for use in apparatus for winding continuously-fed material on a winding mandrel for exchanging winding mandrels without interrupting the supply of tape or sheet material to be wound. Two endless cooperating conveyors are provided to which the ends of the winding mandrels are coupled to permit the horizontal transport of an empty winding mandrel received from a store to a winding station and to a removal station after receiving a full roll. The conveyors have sets of parallel, closely spaced bars, the axes of which are arranged perpendicularly with respect to the direction of movement of the conveyors and the ends of the winding mandrels are allowed to move vertically along the gaps between the bars as the diameter of the roll of material changes on the winding mandrel.

21 Claims, 6 Drawing Figures

DEVICE FOR EXCHANGING A WINDING MANDREL

TECHNICAL FIELD

This invention relates to a device for exchanging a winding mandrel in an apparatus for winding continuously-fed sheet material on a winding mandrel.

More particularly, the invention relates to a device for exchanging winding mandrels without interrupting the supply of tape or sheet material to be wound.

BACKGROUND ART

When winding continuously-fed tape or sheet material, e.g., paper, cloth or foil sheets, the problem is well known of exchanging a winding mandrel having a full roll of material for an empty winding mandrel without interrupting the supply.

Numerous machines have been provided in the past for solving this problem. A storage unit has been provided ro receive the material to be wound during the exchange operation. Such a storage unit has been provided by passing the incoming material around one or a plurality of compensating rollers and increasing the length of the path traveled by the incoming material by increasing the spacing between the compensating rollers, as shown, for example, in German Published Patent Application No. 21 51 829, FIG. 1, numeral 16. The disadvantage of such a storage unit lies in the requirement for a comparatively expensive additional compensating roller device.

It is also known, however, to carry out the exchange of winding mandrels without having an additional storage means. In a well-known device, the winding operation from a fixed roller onto a new winding mandrel which, in turn, lies against a drum, is conducted by carrying the sheet material over a sheet deflecting device shown, for example, in German Published Patent Application No. 27 05 776. This sheet deflecting device comprises a deflecting element which extends over the whole width of the sheet or tape and which is movable between the drum and the fixed roller, thereby deflecting the sheet by establishing a curve of the sheet. The disadvantage of this well-known device, and also the disadvantage of a similar device as described German Accepted Patent Application No. 21 29 410, is that after cutting the continuously-fed sheet material to form the end of the material on a full roll and the subsequent starting end of the material to start a new roll to be wound, there is insufficient distance to allow the usual and static-free transport of the full roll from the winding station.

To overcome this disadvantage, a device for winding long sheet or tape sections has been proposed in which a contact band is located above a conveyor belt by a distance corresponding to the diameter of the roll of material, said contact band running against the direction of movement of the conveyor belt (German Pat. No. 20 02 725). The additional conveyor belt is, however, a comparatively expensive and complicated device.

Another winding machine is known from German Accepted Patent Application No. 19 48 453 in which, after having completed the winding of a full roll and after having cut the sheet material, deterioration in the tight winding by loosening of the roll is prevented. In this machine, rails are provided which are guided by rack-and-pinion gear means.

Still another machine for the continuous winding of moving tapes in known which has a plurality of roll-forming wrappers. This machine comprises a guide for the winding mandrel which is movable on guiding rails and in parallel with respect to a plane established by two rolls whereby guiding ledges are provided at right angles to the direction of movement (German Published Patent Application No. 24 25 454). This multiple-roll winding machine requires, however, two stationary rolls and, additionally, a movable auxiliary roll. Moreover, for carrying out movement, complicated pistons, cylinders, levers and guide rods must be provided.

DISCLOSURE OF THE INVENTION

It is a general object of this invention to overcome the disadvantages of the prior art.

More particularly, it is an object of the invention to exchange a winding mandrel having a large diameter full roll of tape or sheet material and an empty winding mandrel without interrupting the supply of the sheet material to be wound.

Another object of the invention is to provide a device for the horizontal transport of winding mandrels to and from a winding station in which, from the receipt of an empty winding mandrel to the removal of a full winding mandrel from the winding station, the winding mandrels are precisely guided.

A concomitant object of the invention is to provide a device for the horizontal transport of winding mandrels, allowing the supply of empty winding mandrels and removal of full winding mandrels from the device automatically.

Still a further object of the invention is to provide a device which facilitates winding of a continuously-fed tape, even if the tape to be wound is separated into a plurality of narrow tapes, so that it is possible to wind a plurality of narrow tapes simultaneously.

It is a further object of the invention to provide a transport device for winding mandrels which has means capable of guiding the winding mandrels vertically as well as horizontally.

BRIEF DESCRIPTION OF DRAWINGS

For a complete understanding of the invention, reference is had to the following description taken in conjunction with the accompanying drawings, in which.

BEST MODE FOR CARRYING OUT THE INVENTION

Figure 1A:
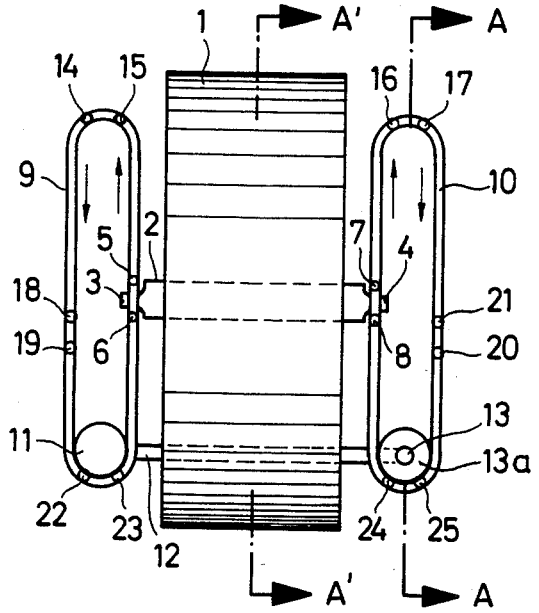
FIG. 1*a* is a fragmentary, schematic top view illustrating a full winding mandrel carried by a transport device according to this invention with the winding mandrel at the winding station.

Turning to the drawings, in FIG. 1*a,* a full roll 1 of material is illustrated on a winding mandrel 2. In accordance with the invention, the ends 3, 4 of the winding mandrel 2 are inserted between two bars 5, 6 and 7, 8, having circular cross sections, respectively, these bars 5, 6 and 7, 8 forming means for coupling and uncoupling the winding mandrels to movable, endless conveyors 9, 10 which are mounted opposite each other. As herein shown, the conveyors 9, 10 are constructed in the form of upper and lower circulating conveyor chains which move the bars along the directions of the arrows shown in FIG. 1*a* to transport the winding mandrels horizontally. The ends 3, 4 of the winding mandrel 2 are provided with lateral recesses, preferably in the form of a quarter circle, so as to adapt these ends to be inserted in the gap between two bars. The drive of the endless conveyors 9, 10 is preferably by an electrical motor 11 which activates one conveyor 9 directly and the opposite conveyor 10 indirectly by a connection including a shaft 12. By means of suitable coupling elements connecting the shaft 12 and the motor 11, e.g., bevel gears or the like, the two endless conveyors 9 and 10 may be moved synchronously along the direction of the arrows, thus guiding the winding mandrel 2 precisely. Numeral 13*a* represents a gear wheel which is driven by a shaft 13 which, in turn, is driven by the shaft 12.

Figure 3:
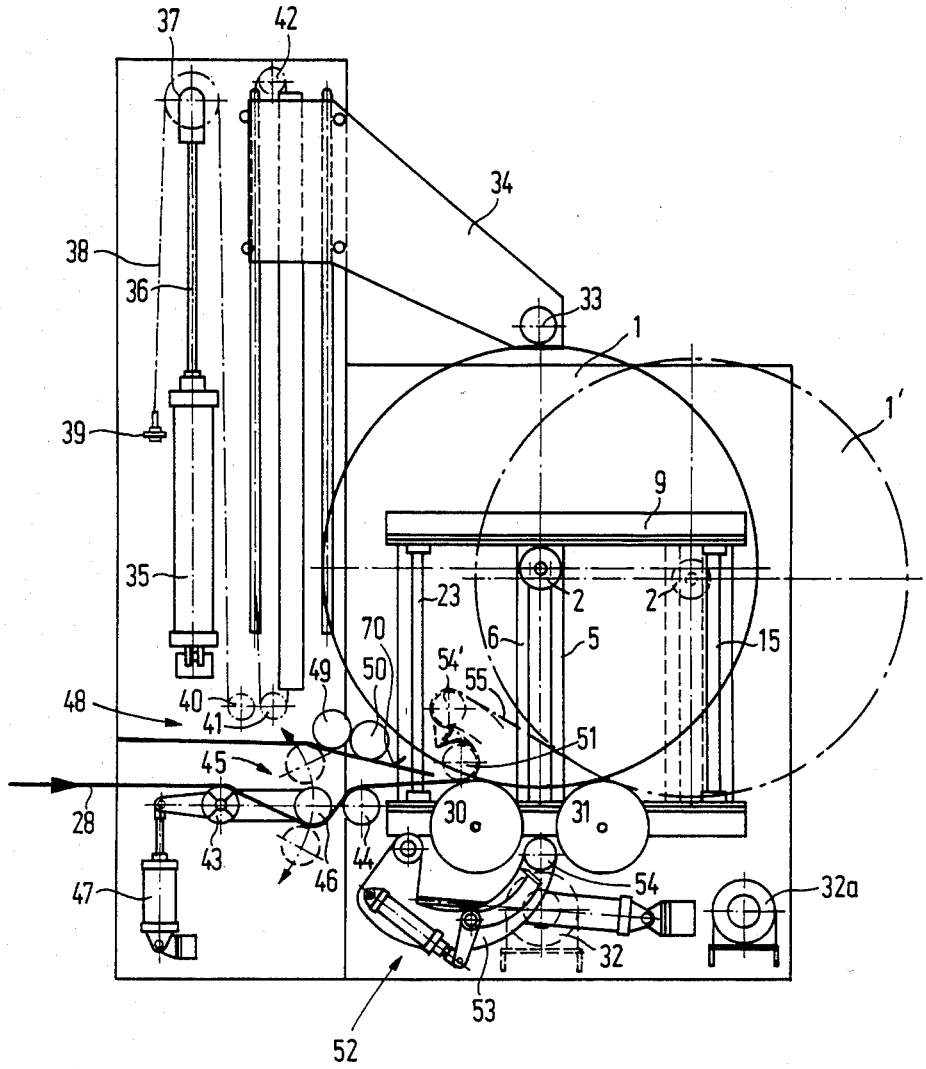
FIG. 3 is a detailed side elevation of the transport device according to the present invention.

In one operating state the winding mandrel 2 is positioned at a winding station, as illustrated in FIG. 1*a*. When held in this position, as shown in FIG. 3, the roll 1 on the winding mandrel 2 is supported by rollers 30, 31 which are driven to rotate the roll and wind the sheet material on the winding mandrel 2. The endless conveyors 9, 10 carry a plurality of sets of circular bars 5, 6, 14, 15, 18, 19, 22, 23 and 7, 8, 16, 17, 20, 21, 24, 25, respectively, which remain as positioned in FIG. 1*a* while the sheet material is wound on a winding mandrel 2 at the winding station. In practice, it is, of course, possible to provide even more sets of bars than shown in FIG. 1*a*.

At the beginning of the winding operation, the starting end of the sheet material to be wound is wrapped on the winding mandrel 2. Gradually the diameter increases of the roll on the winding mandrel 2. When the diameter of the roll reaches a specified diameter, it is desired to sense the presence of a full roll and, either manually or automatically, produce a signal to switch on the motor 11. The endless conveyors 9, 10 will be moved simultaneously by the operation of the motor 11 to transport the full roll 1 on the winding mandrel 2 in the direction of the inner arrows from the winding station of FIG. 1*a* to a removal position as shown in FIG. 1*b*.

Figure 1B:
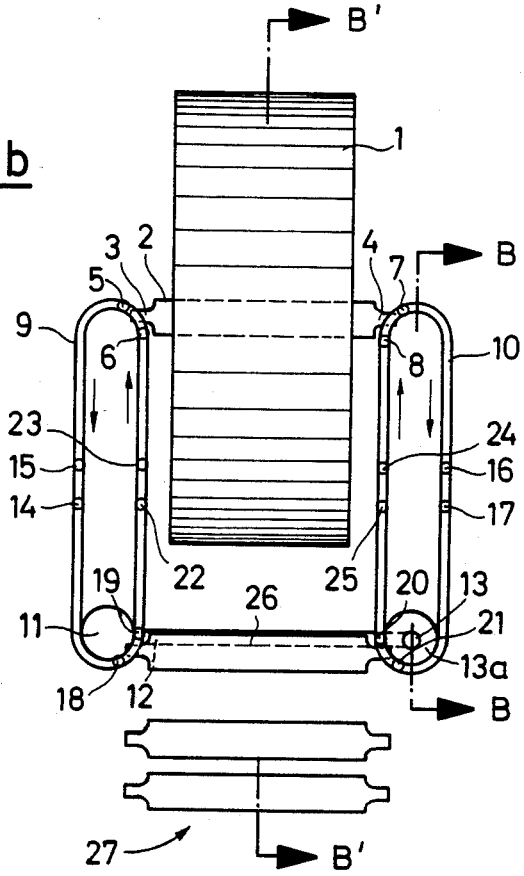
FIG. 1*b* is a similar fragmentary, schematic top view illustrating the full winding mandrel of FIG. 1*a* at the removal position.

When the full roll 1 on the winding mandrel 2 reaches the removal position shown in FIG. 1*b*, the bars 5, 6 and 7, 8, respectively, spread or diverge because of the curvature of the transition section of the path into which they enter. Thus, the full winding mandrel 2 may be removed from the endless conveyors 9, 10. A chute or slide may be provided under the visible end portions of the winding mandrel 2 so as to enable the winding mandrel 2 to roll into a storage for full wound winding mandrels.

In carrying out the invention, to exchange a full winding mandrel 2 with an empty winding mandrel 26 as the full mandrel 2 is transported to the removal position, on the entrance side of the device an empty winding mandrel 26 is inserted, as shown in FIG. 1*b*, and coupled to the movable, endless conveyors 9, 10. This is achieved in the preferred form of the device by means of the bars 18, 19 and 20, 21, respectively, which are carried by the movable, endless conveyors 9, 10 along the semicircular transition section to the straight inner path of the conveyors such that they converge on the ends of the empty winding mandrel 26. The insertion can be carried out automatically, for example, by releasing a pawl 70, normally retaining the empty winding mandrels 49, 50 (FIG. 3) in a winding mandrel store 27. It is to be understood that it is, of course, possible to increase the number of sets of bars carried by the endless conveyors 9, 10 so as to allow winding mandrels to be inserted into the movable, endless conveyors in different phases of the cycle of operation of the conveyors. The newly inserted winding mandrel 26 is moved to the winding station to receive sheet material in the same way as described above in connection with the previous winding mandrel 2.

Figure 2A:
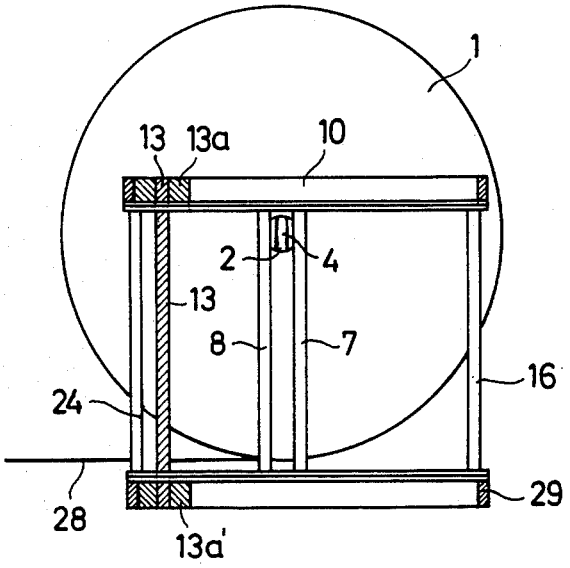
FIG. 2*a* is a fragmentary, schematic side elevation of the device and winding mandrel as shown in FIG. 1*a;*

Referring also to FIG. 2*a*, the device of FIG. 1*a* is shown in side elevation. Further according to this invention, the winding mandrel 2, having a large diameter roll 1, is vertically guided by the parallel, vertical bars 7, 8, which receive the end 4 of the winding mandrel 2 between the bars. By means of the movable, endless conveyor which has both an upper and a lower section, the sets of vertical bars are moved around the loop defined by two straight paths and the semicircular transition sections. Upon movement of the bars, the full roll 1 at the winding station is transported horizontally to the removal position at the right hand side of the apparatus. The shaft 13, driven by the gear wheel 13*a* which is, in turn, connected to the electrical motor 11, moves the gear wheel 13. The teeth of the gear wheels 13*a*, 13*a*′ enter gaps in the conveyor 10, which is preferably a chain, to drive the conveyors 9, 10.

Figure 2B:
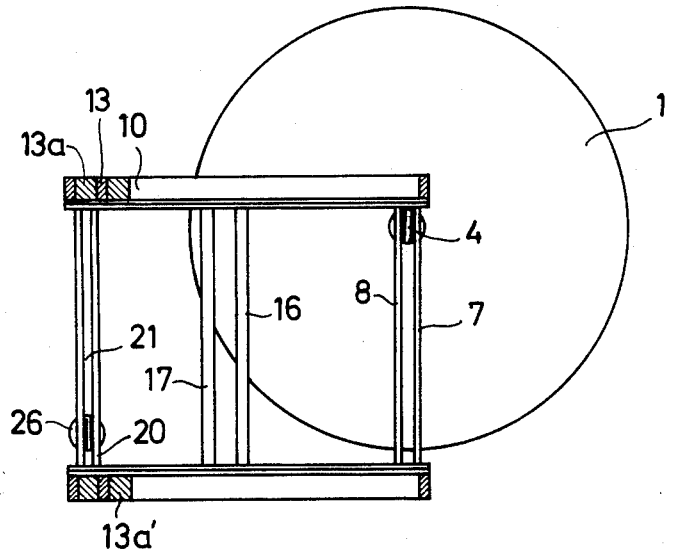
FIG. 2*b* is a fragmentary, schematic side elevation of the device and winding mandrel as shown in FIG. 1*b;*

FIG. 2*b* depicts the full roll 1 in its right hand side end position. Thus, FIG. 2*b* corresponds to Section B—B of FIG. 1*b* in a side elevation. As can be seen from this illustration, the full roll 1 can easily be removed and, simultaneously, a new winding mandrel 26 can easily be inserted. Shaft 13 is omitted in this illustration.

FIGS. 1*a*, 1*b*, 2*a* and 2*b* illustrate the principle of the vertical and horizontal guidance of the winding mandrel 2 only. In practice, of course, elements, such as pawl 70, are provided so as to prevent the sliding down of the winding mandrel 2 along the gap between the bars 7, 8. Such elements are illustrated in FIG. 3.

FIG. 3 depicts a complete device corresponding, in principal, to the devices shown in FIGS. 2*a* and 2*b*, i.e., approximately corresponding to elevations A′—A′ and B′—B′, respectively, (FIGS. 1*a*, 1*b*). The large diameter roll 1 in its winding station, as well as in its removal position, is indicated in dotted lines only. The removal position is designated as 1′ and illustrated as a dash-dot line.

As can be seen from FIG. 3, the device includes two transportion rollers 30, 31 which support and transport the large diameter roll 1. The drive is preferably a friction drive. The rollers 30, 31 are, in turn, driven by a motor 32 which is located beneath the rollers 30, 31. Mechanical gear means between the motor 32 and the rollers 30, 31 are not shown since they are well-known in the art. The motor 32 is provided as a main drive, whereas a second motor 32*a* serves as a transportation roller drive. Also provided in the device is a load sensing roller 33 which rests on the large diameter roll 1 and a load arm 34 is provided by means of which the load sensing roller 33 can be lifted and lowered. The lifting and lowering of the load arm is carried out by means of an hydraulic drive 35 having a piston rod 36 which carries a guideroller 37 for a cable wire 38 which is guided by this guide roller 37 and connected at one end to a fixed projection or the like on the base of the device. This cable wire 38 is also connected via further guide rollers 40, 41, 42 to the load arm 34.

The continuously-fed sheet material 28 to be wound passes over one transportation roller 30 via a first and a second guide roller 43, 44, respectively. A compensation roller assembly 45 is also provided between the guide rollers 43, 44, the assembly 45 having as one component the roller 46 which takes a position giving an indication of the tensile stress or strain of the sheet material 28. An upper and a lower position of the roller 46 are indicated in dotted lines. The tension in the sheet material may serve in a well-known manner as a controlling variable for the speed of the winding operation, whereby this controlling variable, represented by an electrical voltage, is generated in a sensor associated with the hydraulic cylinder 47 for positioning the roller 46.

Above the incoming path of the continuously-fed sheet material 28, a store 48 is provided for empty winding mandrels 49, 50. From this store 48 the empty winding mandrels are shifted to the endless conveyors and inserted into the gap between the guide bars by unlocking a pawl 70.

To direct the sheet material 28 from a full winding mandrel 2 to a new, empty winding mandrel 51, a transfer means, including a pressing and cutting device 52, is provided. This device 52 comprises an hydraulically movable and swingable arm 53 having an hydraulically operated cutter 55 which can be passed between the rollers 30, 31. The end of the arm 53 has a roller 54 movable between a full winding mandrel 2 and an empty winding mandrel 51 to an upper position designated as 54'.

To transfer sheet material from a full winding mandrel 2 to an empty winding mandrel 51, the endless conveyors 9, 10 are operated to transport a full winding mandrel 2 horizontally from the winding station shown in solid lines in FIG. 3 toward a removal position 1' (shown in dash-dot lines) at the right side of the apparatus as viewed in that Figure. The new empty roll 51 also is transported from the entrance position horizontally toward the winding station. The transfer means 53 is operated to insert the guide roller 54 upwardly between the transportation rollers 30, 31 where it picks up the material 28 and forms a loop, shown in dash-dot lines in FIG. 3, extending around the empty winding mandrel 51. The cutting element 55 is operated to cut the sheet material 28 approximately at the point 55' which allows a full roll 1 on the winding mandrel 2 to be removed from the apparatus at the removal position. Also, a new starting end of sheet material is formed. The roller 53 presses the new end of sheet material from above and forms a starting loop around the empty winding mandrel 51 by pressing a part of the material 28 adjacent the end against another part of the material on the entrance side of the empty mandrel 51. This is more clearly shown in FIG. 4, which shows that the new empty winding mandrel 51 is also transported by the movement of the conveyors 9, 10 to the winding station between the transportion rollers 30, 31 which begin turning the empty winding mandrel 51 to wind the continuously-fed material on the mandrel.

Figure 4:
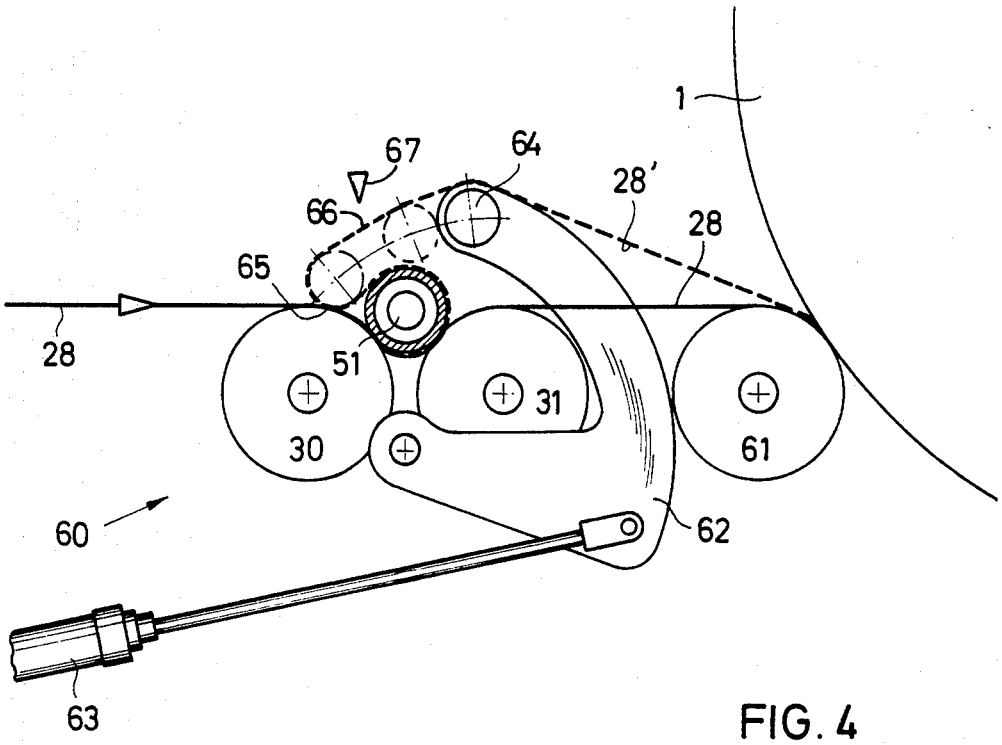
FIG. 4 is a fragmentary, enlarged view of an alternative form of sheet transfer mechanism.

Referring to FIG. 4, an alternative embodiment is shown of the transfer means 52 shown in FIG. 3. This alternative embodiment of transfer means 60 utilizes three transportation rollers 30, 31, 61, thus avoiding having the arm 53 pass between the transportion rollers 30, 31. In this embodiment, the transfer means 60 is normally located in a position (not shown) beneath the rollers 30, 31 which support the roll of material at the winding station.

In the state of the components shown in FIG. 4, the full roll 1 has just been transported away from the rollers 30, 31 and is in contact with the roller 61. The hydraulic cylinder 63 of the transfer means has been operated to pivot the arm 62 to move a roller 64 and thereby pick up the material 28 and form a loop to an upper position around the new, empty winding mandrel 51 in the manner indicated by dashed lines. The material 28 and the countercurrent material 28' meet each other at point 65. The material 28' is then cut, for example, at point 66, and the full roll 1 can be removed. The end of the material 28' will be wound around the winding mandrel 51 to form a starting loop for the new roll.

Other driving means, for instance for the transport of the winding mandrels 2, may be provided. The main condition is that these means should guide the winding mandrel vertically, as well as horizontally, without any jamming. Also, it is not necessary to provide a rigid or continuous winding mandrel. Instead, the winding mandrel may comprise at least one spring which allows the compression of the winding mandrel along its longitudinal axis. Thus, the winding mandrel can be inserted between the gap of two adjacent bars in a position as shown in FIG. 1*a*. In such a case, it would not be necessary to insert or remove the winding mandrel at the respective ends of conveyors 9, 10. Instead, they could be inserted between these ends.

It is an important advantage of the present invention that it is possible to wind very large diameter rolls. Such a large roll, including a winding mandrel and the material to be wound, may have a diameter of 1.5 meters or more. For this purpose, it is necessary to provide an exact vertical guidance. Otherwise the winding would not be symmetrical.

I claim:

1. In an apparatus for winding continuously-fed sheet material on a material receiving winding mandrel, an improved device for the exchange of a full winding mandrel and an empty winding mandrel without interruption of the continuously-fed sheet material to be wound, said device comprising:

a movable, endless conveyor for the horizontal transport of both a full winding mandrel from a winding station and an empty winding mandrel to said station;

means carried by said movable, endless conveyor for coupling and uncoupling a winding mandrel thereto to permit an empty winding mandrel to be received by said conveyor, transported to said winding station for receiving continuously-fed sheet material, and transported to a removal station for removal as a full winding mandrel; and vertical guiding means carried by said conveyor for vertically guiding a winding mandrel while coupled to said conveyor.

2. The device as defined in claim 1 including two movable, endless conveyors mounted opposite each other, each receiving one end of a winding mandrel, and a connection between said endless conveyors for moving said conveyors at the same speed to transport the winding mandrels.

3. The device as defined in claim 2 wherein both endless conveyors comprise endless chain conveyors.

4. The device as defined in claim 1 wherein said movable, endless conveyor receives an empty winding mandrel in a first receiving position of said coupling means, and wherein a full winding mandrel is removed from said movable, endless conveyor in a second removal position of said coupling means.

5. The device as defined in claim 1 including two movable, endless conveyors mounted opposite each other, each of said endless conveyors including a band guided along parallel straight paths joined at each end of said straight paths along a semicircular path providing a transition section.

6. The device as defined in claim 5 wherein said coupling and uncoupling means comprise a pair of vertical parallel bars carried by each conveyor which diverge as they enter a transition section from said straight paths.

7. The device as defined in claim 1 wherein said winding mandrel has at least one end having at least one quadrant-like recess.

8. The device as defined in claim 1 including a sheet material transfer means for directing continuously-fed sheet material from a full winding mandrel at said winding station to an empty winding mandrel, said transfer means being movably mounted for insertion between a full winding mandrel at said winding station and an empty winding mandrel and into contact with so as to direct said sheet material to be wound.

9. The device as defined in claim 8 including cutting means to cut continuously-fed material received by a full winding mandrel at said winding station to permit said material transfer means to direct the material to an empty winding mandrel.

10. The device as defined in claim 8 including a pair of transportation rollers for a roll on a winding mandrel at said winding station and said sheet material transfer means comprising a movable arm having one end provided with a first roller, said arm being movable to insert said first roller between said pair of transportation rollers and into contact with so as to direct the sheet material to be wound from a full roll on a winding mandrel to a new, empty winding mandrel.

11. The device as defined in claim 10 wherein said material to be wound is running over a transportation roller and said first roller is movable to the close vicinity of the continuously-fed sheet material to be wound so that two parts of said continuously-fed material come into contact with each other.

12. The device as defined in claim 1 including a roll diameter sensing roller connected to a sensor means, and means responsive to said sensor means for initiating the exchange of winding mandrels when a predetermined diameter is reached by a roll of wound material on a winding mandrel at said winding station.

13. The device as defined in claim 1 including a store for a plurality of empty winding mandrels adjacent said endless conveyor, and means for shifting said empty winding mandrels from the location of said store into engagement with coupling means carried by said endless conveyor.

14. The device as defined in claim 1 including means for vertically guiding the winding mandrels, said means guiding the winding mandrels in a direction perpendicular with respect to the direction of the horizontal transport.

15. Apparatus for the transport of a winding mandrel, said apparatus comprising:

movable, endless conveyors mounted opposite each other for the horizontal transport of a winding mandrel;

means carried by said conveyors for coupling and uncoupling a mandrel thereto; and said coupling and uncoupling means including two adjacent guiding elements carried by each of said movable, endless conveyors for vertically guiding a winding mandrel.

16. The device as claimed in claim 15 wherein said guiding elements comprise a first pair of parallel bars and a second pair of parallel bars, the space between the first pair of parallel bars being provided for the insertion of one end of a winding mandrel and the space between the second pair of parallel bars being provided for the insertion of the other end of a winding mandrel.

17. Apparatus for the transport of a winding mandrel comprising:

two movable, endless conveyors mounted opposite each other along parallel straight paths for horizontal transport of a winding mandrel received between said conveyors, said conveyors being guided along converging and diverging transition sections; and means including parallel bars carried by each of said conveyors for coupling and uncoupling said opposite ends of a winding mandrel thereto as the conveyors converge and diverge, said parallel bars also guiding a winding mandrel vertically during the horizontal transport.

18. In an apparatus for winding a continuously-fed sheet material on a material receiving winding mandrel, a device for the exchange of a full winding mandrel for an empty winding mandrel comprising:

a transport for holding a full winding mandrel at a winding station in position to receive continuously-fed sheet material and an empty winding mandrel to exchange therewith;

means for cutting said material between said empty winding mandrel and said full winding mandrel;

vertical guiding means carried by said transport for guiding said winding mandrels, said guiding means comprising at least two adjacent guiding elements;

means for moving said transport to move said guiding means for said winding mandrels horizontally, said adjacent guiding elements being carried from an inner path to an outer path along transition sections forming a closed loop;

means for inserting an empty winding mandrel into said guiding means in a transition section between said outer and inner paths of said closed loops, a full winding mandrel being adapted to be removed from said guiding means in a second transition section between said inner and outer paths of said closed loops.

19. Apparatus for the transport of a winding mandrel comprising:

two movable, endless conveyors mounted opposite each other and extending along parallel straight paths spaced to receive opposite ends of a winding mandrel, said conveyors being guided along a converging transition section entering the parallel straight paths and a diverging transition section leaving the parallel straight paths; and means carried by said conveyors for coupling and uncoupling said opposite ends of a winding mandrel as the conveyors converge and diverge as they enter and leave, respectively, the straight paths from the transition sections.

20. The device as defined in claim 19 wherein said coupling and uncoupling means includes a pair of vertical parallel bars carried by each conveyor and receiving opposite ends of a mandrel and uncoupling of the winding mandrel is carried out by the diverging of said pairs of vertical parallel bars.

21. The device as defined in claim 19 wherein said coupling and uncoupling means includes a pair of vertical parallel bars carried by each conveyor receiving opposite ends of a mandrel and coupling of the winding mandrel is carried out by the converging of said vertical parallel bars as they enter the straight paths from the transition section.

* * * * *